US006784439B2

(12) United States Patent
Van Berkel

(10) Patent No.: US 6,784,439 B2
(45) Date of Patent: Aug. 31, 2004

(54) THIN-CHANNEL ELECTROSPRAY EMITTER

(75) Inventor: Gary J. Van Berkel, Clinton, TN (US)

(73) Assignee: UT Battelle, LLC, Oak Ridge, TN (US)

( * ) Notice: Subject to any disclaimer, the term of this patent is extended or adjusted under 35 U.S.C. 154(b) by 245 days.

(21) Appl. No.: 09/910,269

(22) Filed: Jul. 19, 2001

(65) Prior Publication Data

US 2003/0015656 A1 Jan. 23, 2003

(51) Int. Cl.[7] ..... H01J 49/04

(52) U.S. Cl. ..... 250/423 R; 250/281; 250/288; 250/287; 250/493.1; 250/492.1; 250/492.3; 436/172; 436/177; 436/120.1

(58) Field of Search ..... 250/492.1, 492.3, 250/423 R, 281, 282, 284, 286, 287, 288, 493.1; 436/172, 177, 180; 204/180.1, 601, 451

(56) References Cited

U.S. PATENT DOCUMENTS

| | | | | |
|---|---|---|---|---|
| 4,861,988 | A | 8/1989 | Henion et al. | |
| 4,885,076 | A | * 12/1989 | Smith et al. | 204/451 |
| 5,235,186 | A | 8/1993 | Robins | |
| 5,869,832 | A | 2/1999 | Wang et al. | |
| 5,879,949 | A | 3/1999 | Cole et al. | |
| 5,975,426 | A | 11/1999 | Myers | |
| 6,452,166 | B1 | 9/2002 | Enke et al. | |

OTHER PUBLICATIONS

P. Kebarie, "A brief overview of the present status of the mechanisms involved in electrospray mass spectrometry" J. Mass Spectrom. 35, (2000) pp. 804–817.

Van Berkel, "Insights into Analyte Electrolysis in an Electrospray Emitter from Chronopotentiometry Experiments and Mass Transport Calculations", J. Am. Soc. Mass Spectrom., 2000, 11, pp. 951–960.

Van Berkel, "Electrolytic corrosion of a stainless–steel electrospray emitter monitored using an electrospray–photodiode array system", J. Anal. At. Spectrom., Jul. 1995, vol. 13, pp. 603–607.

Van Berkel, et al., "Derivatization for Electrospray Ionization Mass Spectrometry. 3. Electrochemically Ionizable Derivatives" Anal. Chem., vol. 70, pp. 1544–1554.

Van Berkel, et al., "Changes in bulk solution pH caused by the inherent controlled–current electrolytic process of an electrospray ion source" Int. J. Mass Spectrom. Ion Processes, 162 (1997) pp. 55–67.

Van Berkel, "The Electrolytic Nature of Electrospray", Electrospray Ionization Mass Spectrometry, Edited by Richard B. Cole, ISBN 0–471–14564–5 (1997) pp. 65–105.

Van Berkel, et al., "Observation of Gas–Phase Molecular Dications Formed from Neutral Organics in Solution via the Controlled–Current Electrolytic Process Inherent to Electrospray", J. Am. Soc. Mass Spectrom., 7 (1996) pp. 157–162.

(List continued on next page.)

*Primary Examiner*—John R. Lee
*Assistant Examiner*—David A. Vanore
(74) *Attorney, Agent, or Firm*—Akerman Senterfitt

(57) ABSTRACT

An electrospray device includes a high voltage electrode chamber. The high voltage electrode chamber includes an inlet for receiving a fluid to be ionized and for directing the fluid into the chamber and at least one electrode having an exposed surface within the chamber. A flow channel directs fluid over a surface of the electrode and out of the chamber. The length of the flow channel over the electrode is greater than the height of the flow channel over the electrode, thereby producing enhanced mass transport to the working electrode resulting in improved electrolysis efficiency. An outlet is provided for transmitting the fluid out from the electrode chamber. A method of creating charged droplets includes flowing a fluid over an electrode where the length over the electrode is greater than the height of the fluid flowing over the electrode.

33 Claims, 5 Drawing Sheets

OTHER PUBLICATIONS

Van Berkel, et al, "Electrospray as a Controlled–Current Electrolytic Cell: Electrochemical Ionization of Neutral Analytes for Detection by Electrospray Mass Spectrometry", Anal. Chem., 67, No. 21, Nov. 1, 1995, pp. 3958–3964.

Zhou, et al., "Electrochemistry Combined On–Line with Electrospray Mass Spectrometry", Anal. Chem., vol. 67, No. 20, Oct. 15, 1995, pp. 3643–3649.

Van Berkel, et al., "Characterization of an Electrospray Ion Source as a Controlled–Current Electrolytic Cell", Anal. Chem., vol. 67, No. 17, Sep. 1, 1995, pp. 2916–2923.

Van Berkel, et al., "Electrochemical Origin of Radical Cations Observed in Electrospray Ionization Mass Spectra", Anal. Chem., vol. 64, No. 14, Jul. 15, 1992, pp. 1586–1593.

Kertesz, et al., "Minimizing analyte electrolysis in an electrospray emitter" J. Mass Spectrom., 36 (2001), pp. 204–210.

Van Berkel, et al., "Electrochemical Processes in a Wire–in–a–Capillary Bulk–Loaded, Nano–Electrospray Emitter", J. Am Soc. Mass Spectrom. 12, (2001), pp. 853–862.

Richard B. Cole "Some tenets pertaining to electrospray ionization mass spectrometry" J. Mass Spectrom., 35 (2000) pp. 763–772.

de la Mora, et al., "Electrochemical processes in electrospray ionization mass spectrometry" J. Mass Spectrom, 35 (2000), pp. 939–952.

Van Berkel, "Electrolytic deposition of metals on to the high–voltage contact in an electrospray emitter: implications for gas–phase ion formation", J. Mass Spectrom, 35, (2000), pp. 773–783.

Van Berkel, "Computational Simulation of Redox Reactions within a Metal Electrospray Emitter", Anal. Chem., vol. 71, No. 23, Dec. 1, 1999, pp. 5288–5296.

* cited by examiner

THIN-CHANNEL ELECTROSPRAY EMITTER

STATEMENT REGARDING FEDERALLY SPONSORED RESEARCH OR DEVELOPMENT

The United States Government has rights in this invention pursuant to Contract No. DE-AC05-00OR22725 between the United States Department of Energy and UT-Battelle, LLC.

FIELD OF THE INVENTION

This invention relates generally to electrostatic spray devices, and more particularly to an improved electrospray ion source assembly.

BACKGROUND OF THE INVENTION

The electrospray (ES) process generally includes flowing a sample liquid into an electrospray ion source comprising a small tube or capillary which is maintained at a high voltage, in absolute value terms, with respect to a nearby surface. Conventional ES systems for mass spectrometry apply high voltage (relative to a ground reference) to the emitter electrode while holding the counter electrode at a lower, near ground reference voltage. For the positive ion mode of operation, the voltage on the emitter is high positive, while for negative ion mode the emitter voltage is high negative.

However, the emitter electrode can be held at (or near) the ground voltage. In this alternate configuration, the counter electrode is held at high negative voltage for positive ion mode and at high positive potential for negative mode. The voltage drop is the same between the electrodes and the electron flow in the circuit is the same in both the conventional and alternate bias configurations.

The liquid introduced into the tube or capillary is dispersed and emitted as fine electrically charged droplets (plume) by the applied electrical field generated between the tube or capillary which is held at high voltage, referred to as the working electrode, and the nearby surface. The nearby (e.g. 1 cm) surface is commonly referred to as the counter electrode.

The ionization mechanism generally involves the desorption at atmospheric pressure of ions from the fine electrically charged particles. The ions created by the electrospray process can then be used for a variety of applications, such as mass analyzed in a mass spectrometer.

The electrospray ion source operates electrolytically in a fashion analogous to a two-electrode controlled current (CCE) flow cell, effectively forming an electrochemical cell in a series circuit. A metal capillary or other conductive contact (usually stainless steel) placed at or near the point from which the charged ES droplet plume is generated (the ES emitter) is the working electrode in the system. The analytically significant reactions (in terms of ES-mass spectrometry (MS)) generally occur at this electrode.

The rate of charged droplet production by the electrospray source defines the average current (droplet generation rate times average charge per droplet) that flows in the cell (i.e., the ES current, $i_{ES}$). This rate is determined by several interactive variable parameters including the magnitude of the electric field applied between the working and counter electrodes, the solution flow rate, the solution viscosity and electrical conductivity. When used as an ion source for mass spectrometry, the counter electrode of the circuit is generally the atmospheric sampling aperture plate or inlet capillary, the various lens elements and detector of the mass spectrometer.

In a typical ES-MS process, a solution containing analytes of interest is pumped through the ES emitter which is held at high voltage, resulting in a charged solvent droplet spray or plume. The droplets drift towards the counter electrode under the influence of the electric field. As the droplets travel, gas-phase ions are liberated from the droplets. This process produces a quasi-continuous steady-state current with the charged droplets and ions constituting the current and completing the series circuit.

To sustain the buildup of an excess net charge on the surface of the liquid exiting the emitter, heterogeneous (electrode-solution) electron transfer reactions (i.e., electrochemical reactions) must occur at the conductive contact to the solution at the spray end of the ES device. Accordingly, oxidation reactions in positive ion mode (positive high voltage potentials) and reduction reactions in negative ion mode (negative high voltage potentials) will dominate at the ES emitter electrode. Electron transfer reactions also must occur at the counter electrode. Charge can flow in no other way than through these electrode circuit junctions. Thus, electrochemical reactions are inherent to the basic operation of the electrostatic sprayer used in ES applications, such as ES-MS.

The electrolysis reactions that take place in the ES emitter can influence the gas-phase ions formed and ultimately analyzed by the mass spectrometer, because they may change the composition of the solution from the composition that initially enters the ion source. These changes include, but are not limited to, analyte electrolysis resulting in ionization of neutral analytes or modification in the mass or charge of the original analyte present in solution, changes in solution pH through electrolytic $H^+$ or $OH^-$ production/elimination, and the introduction/elimination of specific species to/from solution (e.g., introduction of $Fe^{2+}$ ions from corrosion of a stainless steel emitter).

Other than direct electrolysis of a particular species, redox chemistry or other chemistry can take place via homogenous solution reactions with a species that may be created at the working electrode. Homogeneous solution reactions are also used in controlled-current coulometry.

Applied to electrospray, a homogeneous solution reaction can occur though creating a species at the working electrode, and then diffusing the created species into solution and interacting it with another species causing an effect. This is a homogenous solution reaction, whereas reaction at the working electrode is heterogenous process. Homogeneous solution reactions provide the ability to greatly increase reaction efficiency because not all the analyte needs to get to the working electrode surface to react.

Sufficient time must generally be provided for the homogenous reaction to take place before the material is sprayed. Time between electrochemical reaction and spraying can be provided by an upstream working electrode contact. The electrochemical creation of reactants for the homogenous solution reaction can also buffer the potential to a given level, provided the species reacting is in high enough concentration or the reaction is not diffusion limited. A particular advantage of this approach is the ability to generate unstable reactants (e.g., the oxidant bromine) in situ.

Determining the extent and nature of these solution compositional changes is a complex problem. Because the magnitude of $i_{ES}$ is known to be only weakly dependent on solvent flow rate, the extent of any solution compositional change that the electrolytic reactions can impose necessarily increases as flow rate decreases. The interfacial potential distribution of the working electrode ultimately determines what reactions in the system are possible as well as the rates at which they may occur.

However, in an ES ion source, the interfacial potential is not fixed, but rather adjusts to a given level depending upon a number of interactive variables to provide the required current to the circuit. The variables that are expected to materially affect the interfacial electrode potential include, but are not limited to, the magnitude of $i_{ES}$, the redox character and concentrations of all species in the system, the solution flow rate, the electrode material and geometry. Control over the electrochemical operation of the ES ion source is essential both to avoid possible analytical pitfalls it can cause (e.g. changes to the sample to be analyzed) and to fully exploit the phenomenon for new fundamental and analytical applications which are available through use of ES-MS.

Currently available electrospray emitter designs have not considered structures which can permit improved control of the electrochemistry of the electrochemical cell which can be used for analytical benefit. For example, current electrospray emitter designs do not perform efficient mass transport to the working electrode surface.

SUMMARY OF INVENTION

An electrospray device includes a high voltage electrode chamber having an inlet for receiving a fluid to be ionized and for directing fluid into the chamber and an outlet for transmitting fluid out from the chamber. At least one working electrode has an exposed surface within the chamber, the electrode for electrolytically producing ions from the fluid. A flow channel directs fluid in a flow direction over the surface of the electrode, a length of the flow channel over the electrode in the flow direction being greater than a height of the fluid flowing over the electrode. The electrospray device can include an emitter connected to the outlet for receiving the fluid from the outlet, the emitter for emitting a plume of gas phase ions.

An auxiliary electrode remotely located from the chamber can be provided for emission of ions generated by the working electrode toward the auxiliary electrode, the emission under influence of an electrical field between the electrodes. The emitter can include a non-electrically conductive capillary. A nebulizer can also be optionally added to the emitter to increase gas phase ion production.

The flow channel can include at least one capping member disposed on the working electrode. The capping member can define dimensions of the flow channel and is preferably formed from at least one chemically resistant polymer material. The capping member can include at least one electrode.

At least one dimension of the flow channel is preferably modifiable. The electrospray device can include a feedback and control system, the feedback and control system for modifying at least one channel dimension based on at least one measurement derived from the fluid transmitted from the electrode chamber.

The ratio of length of the flow channel over the electrode in the flow direction to the height of the fluid over the electrode can be at least 10, or preferably at least 100. More preferably, the ratio is at least 1000. Having the channel length over the working electrode greater than the height of the channel over electrode permits the electrospray device to substantially ionize or otherwise react substantially all analyte fluid flowing over the working electrode while maintaining a reasonable flow rate. The thin-layer fluid flow channel also minimizes the mass transport distance for reacting species in the fluid to reach the working electrode.

The working electrode can be disposed in an electrode support member. The electrode support can include at least two working electrodes. Different electrodes can be held at different electrical potentials. When multiple working electrodes are used in the electrode support, the respective electrodes can be formed from different materials, the different materials having different electrochemical potentials, different kinetic properties or different catalytic properties. A structure for application of the different potentials to the respective electrodes can be provided.

When working electrodes are provided in both the electrode support and capping member, the electrode support can be formed from a first material and the electrode in the capping member can be formed from a second material, the materials having different electrochemical potentials, different kinetic properties or different catalytic properties. In this configuration, a structure for applying a potential difference between the electrode in the electrode support and the electrode in the capping member is preferably provided. A voltage divider can be provided for application of a potential difference between working electrodes. When at least two working electrodes are provided, a switching network for switching connection to a high voltage power supply between respective electrodes is also preferably provided.

The surface of electrodes, the electrode support and the capping member can all be substantially planar. A flow member can be disposed between the capping member and the electrode support. In this configuration, the capping member can include at least one electrode.

An electrospray device includes a substantially planar high voltage electrode support including at least one working electrode having an exposed surface for electrolytically producing ions from fluid passing over the electrode, the working electrode support forming a bottom of a fluid flow channel. A capping member forms a top of the flow channel, the flow channel for directing the fluid in a flow direction over a surface of the electrode, a length of the flow channel over the electrode in the flow direction being greater than a height of the fluid flowing over the electrode. The capping member can include at least one electrode.

A mass spectrometer includes a high voltage electrode chamber having an inlet for receiving a fluid to be ionized and for directing the fluid into the chamber and an outlet for transmitting the fluid out from the chamber, at least one electrode having an exposed surface within the chamber, the electrode for electrolytically producing ions from the fluid. A flow channel directs the fluid in a flow direction over the surface of the electrode, a length of the flow channel over the electrode in the flow direction being greater than a height of the fluid flowing over the electrode. An orifice plate is remotely located from the chamber for receiving gas phase ions emitted from the emitter under influence of an electrical field between the electrode and orifice plate.

An electrochemical cell includes a high voltage electrode chamber having an inlet for receiving a fluid to be ionized and for directing the fluid into the chamber and an outlet for transmitting the fluid out from the chamber, and at least one electrode having an exposed surface within the chamber, the electrode for electrolytically producing ions from the fluid. A flow channel directs the fluid in a flow direction over the surface of the electrode, a length of the flow channel over the electrode in the flow direction being greater than a height of the fluid flowing over the electrode. A counter electrode is disposed remotely from the electrode chamber. The electrochemical cell can include a reference electrode in the electrode chamber.

A method of creating charged droplets includes the steps of providing a high voltage electrode chamber including an inlet for receiving a fluid to be ionized and for directing the fluid into the chamber and an outlet for transmitting the fluid out from the chamber and at least one working electrode having an exposed surface within the chamber, the electrode for electrolytically producing ions from the fluid. A flow channel directs the fluid in a flow direction over the surface of the working electrode, a length of the flow channel over the electrode in the flow direction being greater than a height of the fluid flowing over the electrode. The fluid is flowed into the electrode chamber. The length the fluid travels over the working electrode in the flow direction is greater than the height of the fluid over the working electrode. The method can include the step of emitting a plume of gas phase ions from ions generated by the working electrode. At least two electrodes can be provided in the chamber, the method including the step of dynamically switching an electrical potential between respective electrodes. When two or more electrodes are provided in the electrode chamber, the method can include the step of applying a potential difference between respective electrodes.

The method can include the step of dynamically changing at least one dimension of the flow channel. The channel height can preferably be dynamically changed. The dynamic changing can be responsive to at least one measured parameter relating to the fluid, the measured parameter being derived from the fluid. The dynamic changing step can include altering a force applied to the electrode chamber to modify the channel height. The plume of gas phase ions can be used for many processes. For example, the plume can be used for ion mobility spectrometry, spot preparation for matrix-assisted laser desorption mass spectrometry, crop dusting, paint spraying, ink jet printers, ink jet spotters, surface preparation of thin films and mass spectrometry.

BRIEF DESCRIPTION OF THE DRAWINGS

A fuller understanding of the present invention and the features and benefits thereof will be accomplished upon review of the following detailed description together with the accompanying drawings, in which:

FIG. 1(*b*) illustrates an electrospray device according to an embodiment of the invention.

FIG. 2(*b*) illustrates an electrospray device having a capping member and more than one working electrode disposed in the electrode chamber.

FIG. 4(*b*) illustrates a flow member from the device shown in FIG. 3.

FIG. 4(*c*) illustrates a capping member from the device shown in FIG. 3.

FIG. 4(*d*) shows an exploded view of the electrode support, flow member and capping member used to form the electrospray device shown in FIG. 3.

DETAILED DESCRIPTION OF THE PREFERRED EMBODIMENTS

Inherent in the operation of an electrospray (ES) ion source are electrochemical reactions and behavior of the ES source as a controlled-current chemical cell. The invention permits substantial control over many of the significant parameters which affect the electrochemistry that occurs at the working electrode in an electrospray device.

Parametric control of electrospray factors at and near the working electrode can materially affect the electrochemistry of an electrospray process and permit a system to maximize or minimize certain reactions. Thus, a system can be configured to provide, eliminate or otherwise change, the concentration of one or more particular species in solution for analytical benefit. Applied to mass spectrometry, ions observed in the mass spectrum and their relative intensities can be influenced and controlled in a manner not possible with the limited control over the electrochemistry provided by conventional electrospray designs.

Figure 1A:
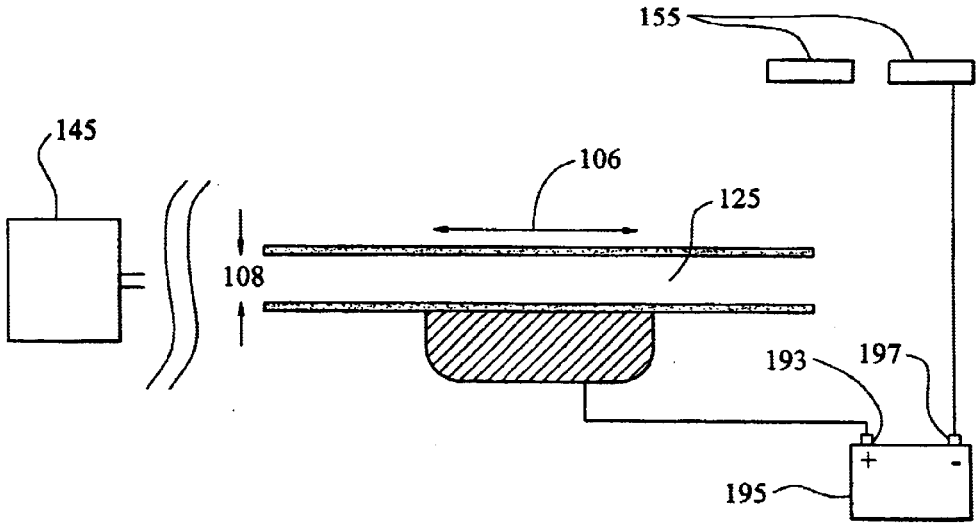
FIG. 1(*a*) illustrates a schematic of an embodiment of the invention
Figure 1B:
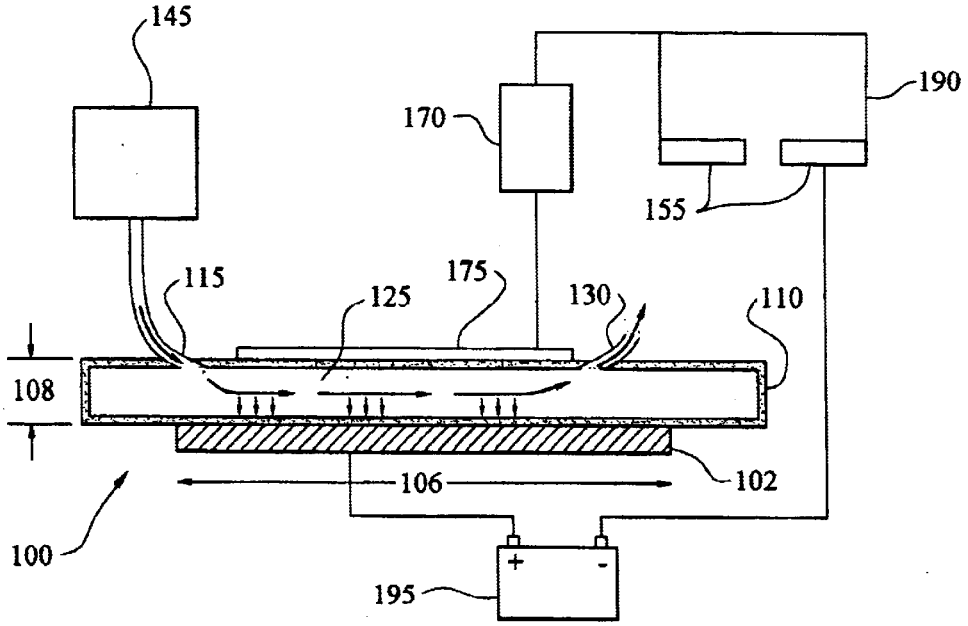

A conceptual drawing underlying an important advantage of the present invention is shown in FIG. 1(*a*). A flow channel 125 directs fluid over, but not through, working electrode 102. Channel 125 has a length 106 in the flow direction over electrode 102 which is greater than the height 108 of the channel 125 over electrode 102. The thin-layer fluid flow channel 125 minimizes the mass transport distance for the fluid to reach electrode 102. The resulting high electrode area to liquid volume ratio over electrode 102 permits an electrospray device to substantially ionize or otherwise react substantially all analyte fluid flowing over electrode 102, while maintaining a flow rate, such as 10 nanoliters/min to 100 microliters/min.

Increasing mass transport electrolysis efficiency improves the reaction rate for any species which reacts at the electrode, provided the reaction is a diffusion limited process. Since the system is generally driven by a pump 145, mass transport is generally by convective-diffusive flux. The net result of the electrochemical reactions is that excess charge will be provided to the solution to sustain the production of charged droplets.

An improved electrospray device 100 according to an embodiment of the invention is shown in FIG. 1(*b*). In this embodiment, the electrospray device includes at least one high voltage "working" electrode 102 positioned within an electrode chamber 110 having inlet 115 and outlet 130. The working electrode 102 is one electrode in the in the two-electrode system of the electrostatic spray device 100, the other electrode being a counter electrode, such as the orifice plate 155 of mass spectrometer 190.

Working electrode 102 is generally electrically connected to the high voltage terminal 193 of high voltage power supply 195 for positive ion mode, and low voltage terminal 197 for negative ion mode. Orifice plate 155 is held at low potential through connection to low voltage terminal 197 as shown in FIGS. 1(*a*) and 1(*b*) to achieve operation in positive ion mode. In negative ion mode, orifice plate can be connected to high voltage terminal 193, while working electrode can be connected to low voltage terminal 193. Although a single power supply 197 is shown in FIGS. 1(*a*) and 1(*b*), more than one power supply (not shown) can also be used with the invention.

Working electrode 102 is preferably a substantially planar electrode as shown in FIG. 1 to limit flow resistance and void volume. Pump 145 can be used to force analyte fluid through inlet 115 into electrospray device 100 to pass over the working electrode 102.

More than one working electrode can be provided within electrode chamber 110, such as 2 electrodes. Electrical contact from high voltage power supply 195 can be made to any one or all electrodes though direct electrical connection or switching of respective electrode leads to high voltage power supply 195. When multiple electrodes are provided, a switching system can be added to switch power supply connection between the respective working electrodes to permit varying electrospray conditions. This switching is preferably automatic. A voltage divider (not shown) can be added to provide different levels of high voltage to the respective electrodes.

Multi-electrode chamber configurations can add additional electrochemical cells into the circuit, the additional electrochemical cells formed between pairs of the respective electrodes. The different electrodes can utilize different electrode materials, the different materials having different electrochemical potentials, different kinetic and/or catalytic effects. This can allow generation of a higher interfacial electrode potential than otherwise possible if relying only on the inherent controlled-current electrolytic process of electrospray. The additional electrochemical cell formed in this embodiment can also be used to overcome, at least in part, the current-limited nature of the electrochemical process in the electrospray ion source. Higher currents provide for a greater magnitude of electrolysis, which for example, improves electrolysis efficiency which can enable use of higher pumping rates.

As volumetric flow rates increase in electrospray processes generally beyond approximately 10 mircoliters/min, the mass transport through the system 100 of species present at concentrations of a few micromolar or more can begin to exceed in equivalents the current capacity of the system. As an example only, the current capacity of the system 100 in a single-electrode chamber embodiment can be approximately 0.1–0.5 microamps. The current capacity for a given electrospray system can be calculated using Faraday's law.

Electrode chamber 110 forms a thin-layer flow channel cell defined by channel 125 to direct fluid over working electrode 102. Flow channel 125 is provided for directing the fluid over a surface of electrode 102, rather than through the electrode as in conventional hollow tubular electrode systems. A length 106 of the flow channel over the working electrode 102 in the flow direction is greater than the height of fluid 108 in flow channel 125 over working electrode 102. This configuration results in a very high working electrode area to liquid volume ratio in the region over the working electrode 102.

The thin-layer fluid flow channel 125 minimizes the mass transport distance for the fluid, the mass transport distance being the distance the species in the fluid must diffuse to reach the working electrode 102. Being convective transport dominated, diffusion occurs substantially perpendicular to the working electrode surface based on the concentration gradient in respective stacked layers of fluid on electrode 102, the respective layers having substantially uniform potential. In most applications, it is preferable for the overall fluid volume to be low so that fast transport from the working electrode 102 to the spray tip (not shown) results.

The high electrode area to liquid volume ratio provided by electrode chamber 110 permits an improved opportunity for analyte fluid to reach electrode 102. Thus, electrospray device 100 efficiently electrochemically changes the charge balance by adding more of one ion polarity or discharging the other ion polarity, or both of these charge exchange processes. As a result, an excess of one ion polarity is obtained creating the conditions to form charged droplets. This arrangement results in little material escaping the system without coming in contact with the electrode surface. After passing over the electrode, fluid is directed by channel 125 to outlet 130 out of electrode chamber 110.

It is generally desirable to maximize the ratio of length 106 to height 108. Although flow resistance increases as channel height decreases, the resulting increased ionization efficiency permits pump 145 to increase the pumping rate without reducing ionization efficiency to achieve a desired flow rate. In one embodiment, the ratio of electrode length 106 to channel height 108 is at least 10, such as 25, 40, 60, and 75. In a more preferred embodiment, the ratio is at least 100, such as 250, 400, 600 and 750. In a most preferred embodiment, the ratio is at least 1,000, such as 2,000, 4,000, 6,000 and 7,500.

A short mass transport distance to a surface of working electrode 102 is provided from any point in the chamber 110, thus improving electrolysis efficiency compared to convention electrospray emitters. For maximum theoretical electrolysis efficiency to occur, all species must contact the working electrode surface. Efficient analyte electrolysis can be used to increase analyte signal intensity through enhanced electrochemical ionization, to study analyte electrochemistry properties, or to create novel types of gas-phase molecular ions with the ES ion source. The latter case includes molecular ions $M^+$ and $M^{2+}$ formed by electron transfer chemistry as compared to the normally observed $(M+H)^+$ and $(M+2H)^{2+}$ ions formed by acid-base chemistry.

The electrospray device 100 can be configured to permit at least one dimension of flow channel 125 to be modifiable by application of at least one external force. For example, the electrode chamber 110 can include compressible material. If the material used to form electrode chamber 110 responds to electric and/or magnetic fields, dimensions of flow channel 125 may also be altered through use of electromagnetic forces, rather than mechanical force as in the case of a compressive force.

For example, provided electrode chamber 110 includes a compressible material, the channel height 108 can be modified through application of a force, such as a compressive force, applied to electrode chamber 110. The electrospray device 100 can further include a feedback and control system 170, the feedback and control system 170 for commanding a structure for adjustable application of a compressive force 175 to the electrode chamber 110. The magnitude of the force applied can be based on at least one measurement derived from fluid transmitted from the electrode chamber 110, such as the gas-phase current of a particular analyte at mass spectrometer 190.

Outlet 130 is preferably connected to an emitter (not shown). Following emission from the emitter (not shown), gas phase ions are sprayed towards a counter electrode 155 under the influence of an electrical field created by a potential difference imposed between working electrode 102 and counter electrode 155.

Another potential advantage of the invention is the ability to vary the time delay from the passage of the analyte over the working electrode 102 to the time fluid exits the emitter (not shown). If desired, the time delay can be controlled by changing flow rate of the fluid by altering the pumping speed of pump 145, or by changing the dimensions of the emitter (not shown). Reactions brought about because of the electrochemistry at the working electrode 102 can be studied as a function of reaction time in this fashion. Time delay can varied such that there is little time for other reactions to occur between ionization by the working electrode 102 and emission from the emitter to configurations where there are tens of seconds of time delay for reactions to occur.

Figure 2A:
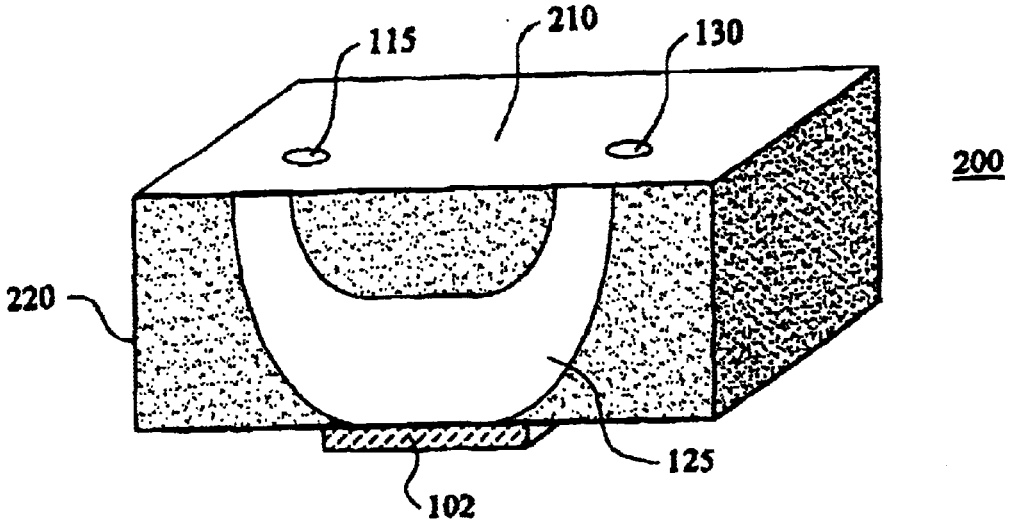
FIG. 2(*a*) illustrates an embodiment of the invention showing an electrospray device having a capping member.
Figure 2B:
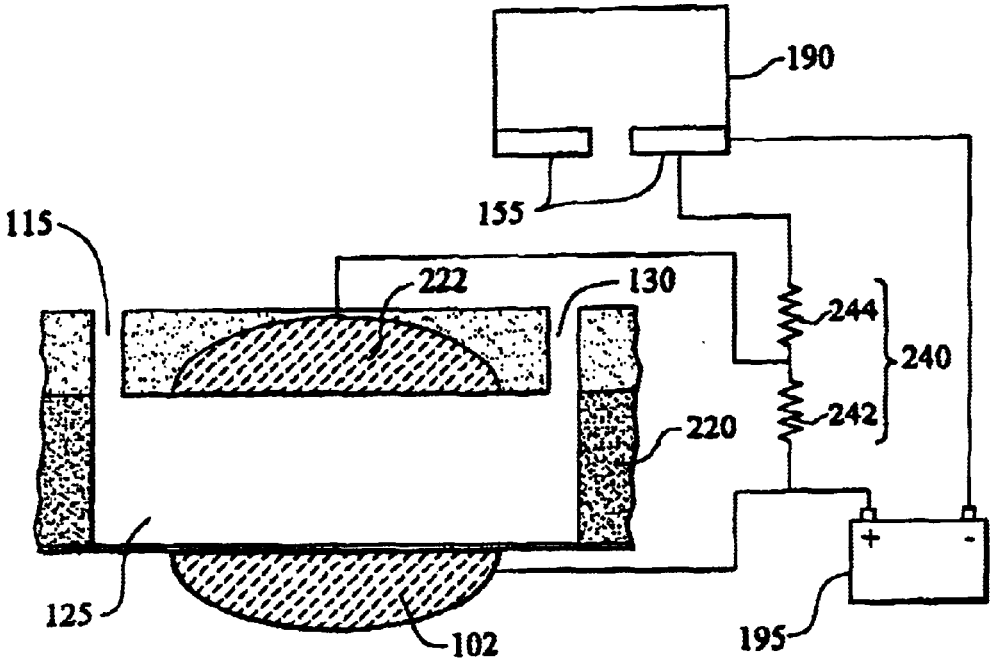

In an alternate embodiment of the invention, an electrospray device 200 can include an electrode chamber 220 having at least one capping member 210 disposed on at least one electrode 102, the capping member 210 together with electrode 102 defining the dimensions of the flow channel 125. Referring to FIG. 2(*a*), capping member 210 is preferable made from a chemically resistant, substantially non-porous and non-electrically conductive, strong and compressible material.

Thus, provided capping member is compressible, application of a compressive force can alter one or more dimensions of flow channel 125, including modification of the channel height 108. If the material used to form capping member responds to electric and/or magnetic fields, dimensions of flow channel 125 may be altered through use of electromagnetic forces, rather than mechanical force as in the case of a compressive force. Flow channel dimensions may also be modifiable by providing capping member 210 and electrode 102 formed in appropriate geometries to permit relative motion while maintaining a seal to the environment.

As shown in FIG. 2(*b*), electrospray device 200 can include more than one electrode disposed in electrode chamber 220. In this embodiment, analyte electrolysis is enhanced further by adding at least one electrode 222 to capping member 210 so that the electrode 222 is disposed opposite electrode 102. Added electrode 222 can be biased using an additional power supply (not shown) or by a voltage dividing 240 comprising multiple resistors, such as resistors 242 and 244, for dividing the potential generated by high voltage power supply, 295. Although a single power supply 195 is shown in FIG. 2(*b*), use of an additional power supply (not shown) can provide more current to the system.

The above multi-working electrode embodiment effectively decreases the maximum mass transport distance to a working electrode surface, the mass transport distance being effectively perpendicular to the respective electrode surfaces. In addition, this configuration can allow generation of a higher interfacial electrode potential than otherwise possible if relying only on the inherent controlled-current electrolytic process of electrospray.

Figure 3:
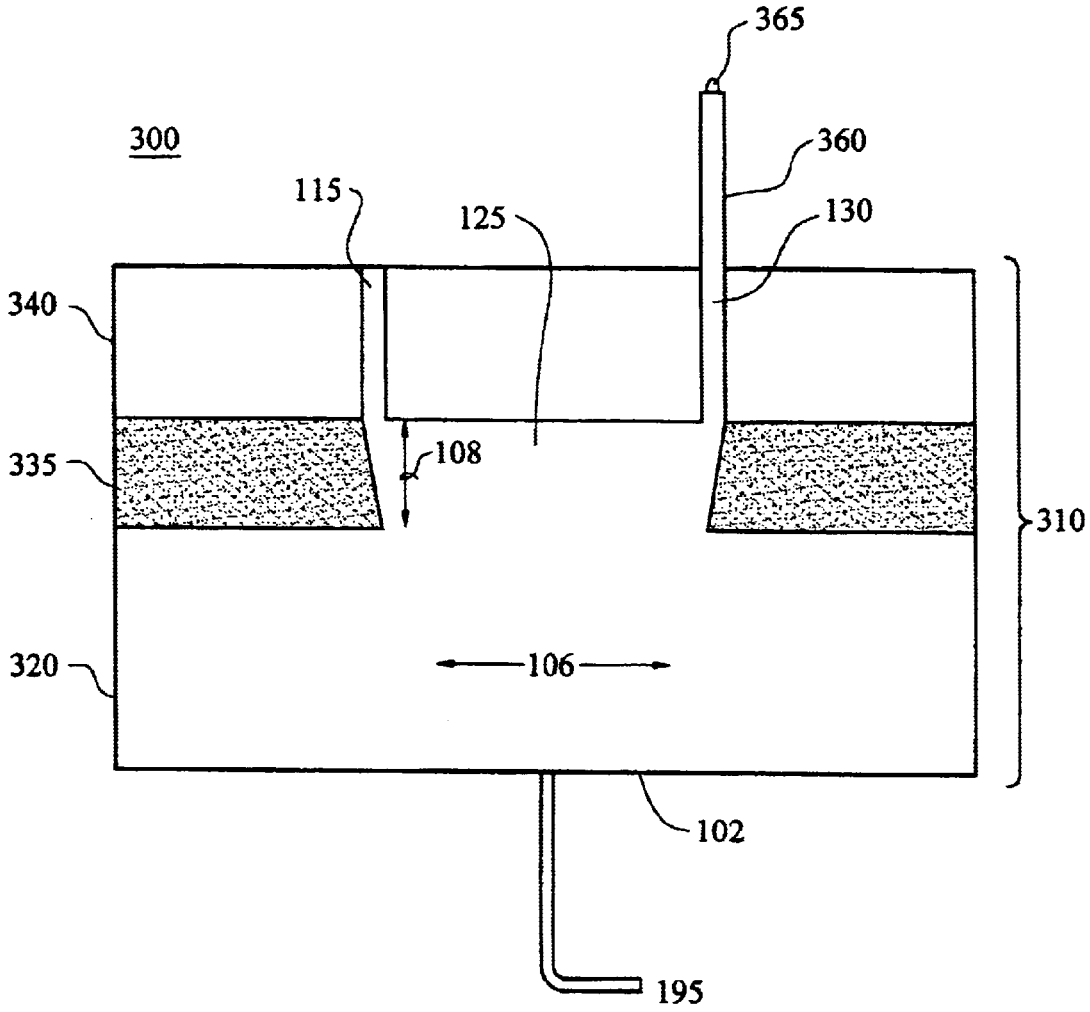
FIG. 3 illustrates an electrospray device having an electrode support member, flow member and capping member according to another embodiment of the invention.
Figure 4A:
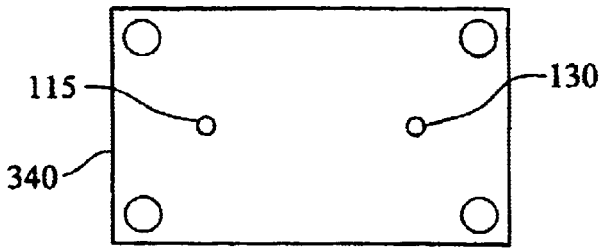
FIG. 4(*a*) illustrates an electrode support member from the device shown in FIG. 3.
Figure 4B:
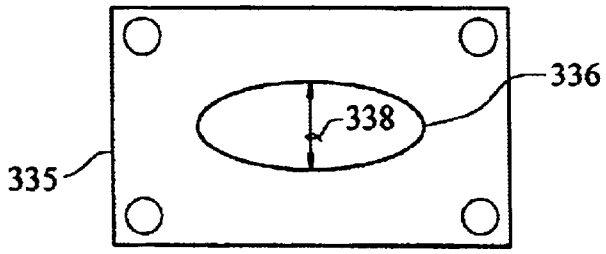
Figure 4C:
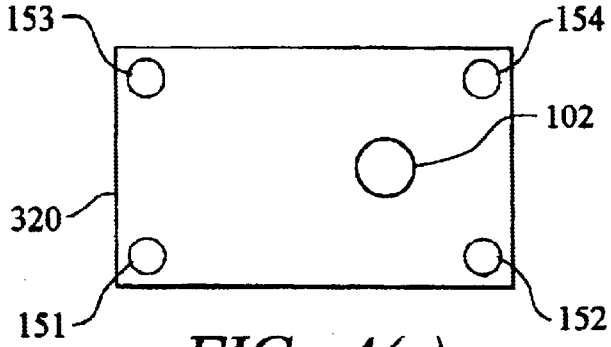
Figure 4D:
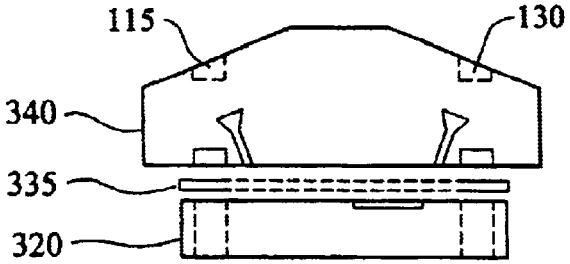

A three component embodiment of the invention is shown in FIG. 3. Electrospray device 300 shown is formed by stacking three (3) members, capping member 340, flow member 335 and electrode support member 320. Exploded views of preferred embodiments of these members are shown in FIGS. 4(*a*), 4(*b*) and 4(*c*), respectively and their resulting stacked combination in FIG. 4(*d*). Members 340, 335 and 320 are each preferably substantially planar. In this embodiment, the physical dimensions of the flow channel 125 are defined by the electrode support member 320 including working electrode 102 combined with adjacent flow member 335. Capping member 340 is shown disposed on flow member 335. Although both the inlet 115 and outlet 130 are provided by capping member 340, the invention is in no way limited to this arrangement.

Electrode support member 320 is preferably made from materials capable of forming an effective seal, being substantially electrically non-conductive, having high strength and resistance to a wide variety of organic and inorganic liquids, including solvents. In one preferred embodiment, members 320 and 340 are formed from polyetheretherketone (PEEK), PEEK being a very inert, hard polymer material.

In one example embodiment, the flow channel length measured between input 115 and output 130 is approximately 2 cm, while the length 106 over working electrode 102 in the flow direction is 6 mm, the working electrode shape being in the shape of a disk having a 6 mm diameter. Working electrode 102 can be provided in a variety of other shapes such as rectangular. The respective flow channel length measured between input 115 and output 130 can be made longer or shorter than this value.

The channel width (shown in FIG. 4(*b*) as reference 338) and channel height 108 can be determined by the dimensions of flow member 335, which can be a spacing gasket. The thickness of gasket 335 can determine the height of fluid over working electrode 102, while the channel width 338 can be determined by the dimension of an opening in gasket 335 in the direction indicated by width 338. The spacing gasket is preferably formed from polytetrafluoroethylene, or from materials having similar nonelectrically conductive, substantially non-porous properties. The volume and mass transport characteristics of electrospray device 300 can be altered by varying a variety of parameters including the working electrode size or shape, spacing gasket thickness, and solution flow rate.

Working electrode 102 is planar in the preferred embodiment of the invention. However, working electrodes need not be planar. For example, electrodes can have surface topography other than planar. Electrode topography can also increase total surface area of the electrode for a given geometric length/diameter, increasing the surface-to-volume ratio. A single non-planar working electrode 102 would generally results in non-uniform channel height 108 over the electrode area. However, if an electrode is added to capping member 340 opposite electrode support member 320 and respective working electrode topographies track one another, a nearly constant channel height 108 in the channel region between respective working electrodes can result.

The gasket thickness and resulting channel height 108 can be made in a wide variety of sizes. However, in most applications, a minimum channel height 108 will be preferable to achieve optimum mass transport to the working electrode 102. For example, in one embodiment the gasket thickness can be 0.0005 inches thick. Gaskets thinner than 0.0005 inches are expected to be provide even better performance for many applications.

Gasket 335 shown has a void region 336 configured in an oblong shape. Void region 336 can alternatively be replaced with a porous material filling the same region to similar flow properties. Void region 336 can be any of a variety of shapes, provided the shape chosen allows fluid to enter electrode chamber 310, pass over the working electrode 102, and out of the electrode chamber 310. For example, void region 336 can have a spiral, serpentine, or rectangular shape.

Additional working electrodes can be provided. The working electrode member 320 can be provided more than one electrode, such as 2 electrodes. Alternatively, capping member 340 can provide one or more working electrodes.

In a first multi-electrode configuration, the electrospray device 300 can add another two-electrode electrochemical cell into the circuit, the additional electrochemical cell formed between two electrodes which can be disposed on electrode supporting member 320. Each working electrode can utilize different materials, the different materials having differing electrochemical potentials, different kinetic and/or catalytic properties. With multiple electrodes available, a switching system can be added to switch between respective working electrodes to permit varying electrospray conditions. The switching is preferably automatic.

Alternatively, or in combination with the embodiment having multiple electrodes on electrode supporting member 320, analyte electrolysis might be enhanced further by adding an electrode to capping member 340, preferably disposed directly opposed to the working electrode provided by electrode support member 320. This embodiment effectively decreases the maximum mass transport distance to a working electrode surface by a factor of 2, the mass transport distance being effectively perpendicular to the respective working electrode surfaces. Also, a voltage divider might be added between the two electrodes. This could allow generation of a higher interfacial electrode potential than otherwise possible if relying only on the inherent controlled-current electrolytic process of electrospray. The additional electrochemical cell formed in this embodiment can also be used to overcome, at least in part, current-limited electrolysis in the electrospray ion source. Higher levels of electrolysis allows improved emitted current levels through utilization of higher pumping rates.

Control of the working electrode potential can be improved through use of a reference electrode (not shown). For example, a three electrode system, including a working electrode, a counter electrode and a reference electrode, can be used with the invention. An additional external voltage source is generally connected to the reference and working electrode. This permits a potentiostat to be configured. A potentiostat can be used to produce a voltage output at an electrode to be controlled that is given by some control voltage (e.g. from an external voltage source) minus the voltage at the reference electrode input, multiplied by a large gain factor. The voltage from the reference electrode provides negative feedback for the potentiostat. Operational amplifiers are preferably used for this purpose.

Electrode support member 320 is preferably held against capping member 340, separated by flow member 335 (e.g. spacer gasket), by at least one fastener (not shown). The fasteners can be inserted through members 320, 335 and 340 using holes 151–154 to align and compress the respective members together. In the preferred embodiment, the fasteners used are turn screws. For example, approximately one turn of the screw counter clockwise can permit removal of the electrode support member 320. This fitting system is available from Bioanalytical Systems, Inc. 2701 Kent Avenue West Lafayette, Ind. 47906, which uses these fasteners on thin-layer electrochemical cells used as detectors for liquid chromatography. The ability to quickly and easily disassemble and reassemble the electrode chamber 310 allows for the electrode area, electrode material, and channel height 108 to be rapidly and conveniently modified.

Using the turn screw fasteners described, electrode support member 320 is easily removable. One can remove electrode support member 320 including working electrode 102 and replace it with another electrode support member 320, such as one having a different electrode material or different electrode area. The effective electrode size and shape can be varied by either changing the physical size or shape of the electrode 102 or by changing the shape of the void region 336 in fluid member 335 (e.g. spacing gasket).

The invention provides the ability to easily change a plurality of parameters associated with the working electrode in terms of electrochemistry that cannot be provided by simply changing conventional tubular electrodes. For example, the invention permits rapid modification to deploy a wide variety of electrode materials, electrochemical and chemical modification of those electrodes, changing the size and shape of the electrode (electrode area), and the mass transport to the working electrode.

Figure 5A:
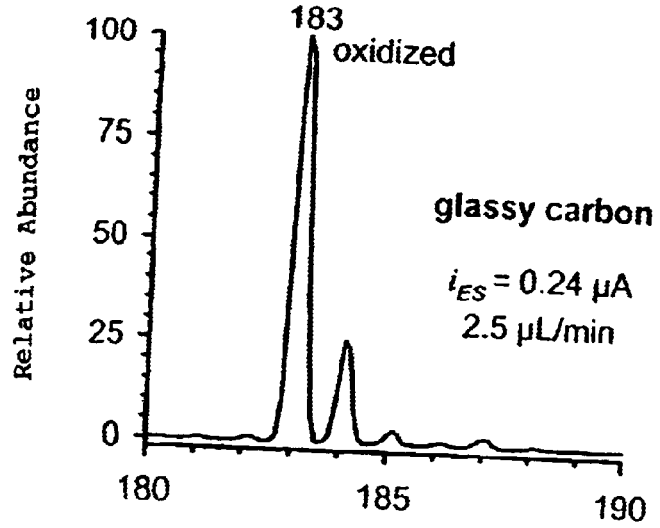
FIGS. 5(*a*), (*b*) and (*c*) shows the relative abundances of various species observed in the gas-phase from an electrospray device using the configuration shown in FIG. 4 with glassy carbon, silver and copper electrodes, respectively.
Figure 5B:
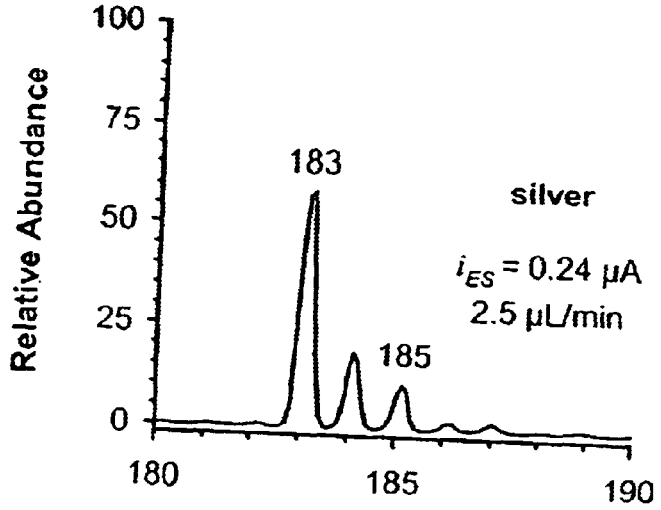
Figure 5C:
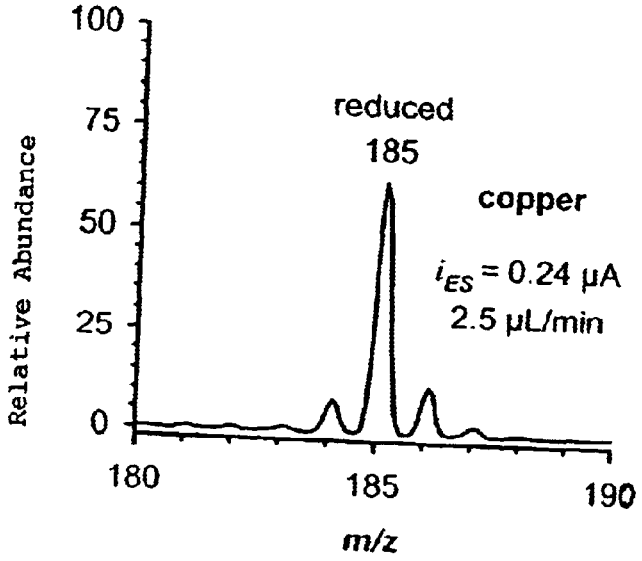

Changing the electrode material can significantly impact the operation of electrospray device 300. For example, FIGS. 5(*a*), (*b*) and (*c*) show the gas-phase species observed from operation of an electrospray device using the configuration shown in FIGS. 4(*a*)–(*d*) with glassy carbon, silver, and copper electrodes, respectively. Each electrode had the same area. All other parameters were held constant, such as fluid flow equal to 2.5 $\mu$L/min and electrospray current equal to 0.24 $\mu$A. N-phenyl-1,4-phenyldiamine ($E_{pn}$≈0.45 V vs SHE, 20 $\mu$M in $H_2O/CH_3OH$, 5.0 mM $NH_4OAc$, pH 4) was used as the fluid. The protonated molecule for this species was observed at m/z 185, while its oxidation product, N-phenyl-1,4-phenyldiimine, was observed as a protonated molecule at m/z 183. The data shown in FIGS. 5(*a*), (*b*) and (*c*) demonstrates that the extent of analyte oxidation and the absolute abundances of the individual species observed in the gas-phase can be substantially dependent on the nature of the electrode material selected.

The electrospray device 300 can be configured to permit at least one dimension of flow channel 125 to be modifiable by application of at least one external force. Accordingly, the channel height 108 can be modified through application of a force, such as a compressive force, applied to gasket 335. Provided gasket 335 is compressible electrospray device 300 can further include a feedback and control system, the feedback and control system for adjustable application of force to the gasket 335. The magnitude of the force applied can be based on at least one measurement derived from fluid transmitted from the electrode chamber 310, such as the gas-phase ion current of a particular analyte.

The electrode configuration shown in FIGS. 3 and 4 also permit cleaning the working electrode, such as electrode 102, which are otherwise normally narrow bore tubes. This flow-over design as compared to conventional flow through designs also essentially eliminates the problem of plugging of the emitter tubes which can be a major expense if the tube is rare metal, such as platinum, for example. Tubular electrodes are susceptible to plugging such that they can become unusable.

If electrodes are made of noble materials (e.g. glassy carbon, gold, platinum) are used with the invention, they will generally be useful for many years. Electrode materials which significantly corrode, such as zinc, copper, stainless steel and silver will still have long lifetimes using the invention because of the generally low electrospray currents. For example, if the electrospray current is 0.1 $\mu$A, these materials can be expected to last several years. Thus, except for the most easily oxidizable electrodes operated in positive ion mode, the electrodes used in the invention, with reasonable care, should not wear out or otherwise require replacement because of processes occurring during normal use of the electrospray device 300.

The analyte preferably exits the electrode chamber 310 from outlet 130 and is directed into a non-electrically conductive capillary 360 which can be connected to a smaller diameter emitter tube 365. The combination of capillary 360 and emitter tube 365 forms a remote emitter for spraying. A remote emitter refers to an emitter remotely being upstream relative to the high voltage of the working electrode 102.

With the non-conductive capillary emitter 360/365 at low field as opposed to conventional metal capillary electrodes which are held at high field, the likelihood of a corona discharge at the tip of spray capillary is minimized. The liquid from the spray tip 360/365 to the electrode 102 in the device 300 acts as a limiting resistor in the series electrochemical circuit formed, and thus, as a discharge suppressor. Therefore, it should have better performance in negative ion mode than the normal metal capillaries where discharge is likely.

Capillary 360 preferably has a nominal inner diameter of 10 and 50 $\mu$m , and is connected to a comparatively short, smaller diameter capillary emitter 365. Capillary emitter tube 365 preferably has a smaller diameter than capillary 360 to produce smaller diameter droplets. The length of emitter 365 is preferably shorter than capillary 360 to limit flow resistance. Emitter tube 365 preferably has an interior diameter of 2 and 5 $\mu$m . Capillary 360 and emitter tube 365 can be both formed form fused silica.

Although shown as separate capillary elements 360 and 365, a single capillary can be used. The single capillary can have uniform inner diameter, or be formed with a smaller diameter tip relative to the remaining length of the capillary tube. Generally, larger inner diameters will be used to support higher flow rates.

The glass nonconductive emitters, without conductive contacts, are generally inexpensive and can be disposed of rather than cleaned without expense. The non-conductive capillary can include an auxiliary nebulization. A nebulizer (not shown) can be used as an additional droplet generator to enhance gas-phase ion formation for some solutions which may be difficult to vaporize, prior to emission towards a counter electrode.

Although not required, redox buffers can be used to control of the interfacial electrode potential distribution surrounding electrode 102, because the electrospray ion source operates as a controlled-current electrolytic cell. Oxidation or reduction of the redox buffer at the working electrode(s) 102 can be used to maintain the electrode at that potential. By appropriate selection of the working electrode material, the corrosion of the electrode in positive ion mode can be used to obtain this redox buffer effect without requiring the addition of a redox buffer.

In addition, the metals supplied by the corrosion process can eliminate the need to add these metals to solution as salts. The metals can be used to enhance signal levels by coordination with the analyte, can be used to help in analyte structure determination by tandem mass spectrometry or used in metal-ligand complex chemistry studies, such as metal-ligand stoichiometries.

Redox buffering in negative ion mode can be achieved by the use of materials, such as platinum, that have a low over-potential for hydrogen generation compared to those materials that do not (e.g., glassy carbon). Some suitable electrode materials that might be used as redox buffers in positive ion mode include, but are not limited to, glassy carbon ($E^0$>1.5 V vs standard hydrogen electrode (SHE)), gold ($E^0_{Aw/Aw}{}^{2+}$≈1.4 V vs SHE), platinum ($E^0_{Pt/Pt}{}^{2+}$≈1.2 V vs SHE), palladium ($E^0_{Pd/Pd}{}^{2+}$≈0.83 V vs SHE), silver ($E^0_{Ag/Ag}{}^{+}$≈0.7996 V vs SHE), copper ($E^0_{Cu/Cu}{}^{2+}$≈0.3402 V vs SHE), lead ($E^0_{Pb/Pb}{}^{2+}$≈−0.126 V vs SHE), tin ($E^0_{Sn/Sn}{}^{2+}$≈−0.1364 V vs SHE), nickel ($E^0_{Ni/Ni}{}^{2+}$≈−0.23 V vs SHE), cobalt zinc ($E^0_{Co/Co}{}^{2+}$≈−0.28 V vs SHE), thallium ($E^0_{Tl/Tl}{}^{+}$≈−0.3363 V vs SHE), indium ($E^0_{In/In}{}^{3+}$≈−0.338 V vs SHE), cadmium ($E^0_{Zn/Zn}{}^{2+}$≈−0.4026 V vs SHE), and zinc ($E^0_{Zn/Zn}{}^{2+}$≈−0.7628 V vs SHE).

By controlling the interfacial potentials with appropriate redox buffers, one can ensure that species with $E^0$ values below a certain magnitude will not undergo an electrolysis reaction. In addition, channel height 108 can be used to control the heterogeneous (electrode-solution) reaction rate. For example, by increasing the channel height 108, the heterogeneous reaction rate and resulting electrolysis efficiency for the analyte can be reduced for a given volumetric flow rate, because of the longer mass transport distance (and transport time) to the electrode 102.

Use of redox buffers also permits control over reactions that alter solution pH (e.g., oxidation or reduction of water), analyte electrolysis, or unwanted modification of unknown analytes. Addition of a redox buffer can provide for coulometric titration of a particular analyte species in solution. This can greatly increase reaction efficiency because the analyte need not reach the working electrode surface to react.

By changing the electrode potential and observing if the analyte is altered in either charge, mass or structure one can bracket the equilibrium potential for the analyte in question. Because material isolated for an electrochemical study may be limited, changing the electrode potential and observing if the analyte is altered represents a method to get fundamental electrochemical information on an analyte with very small amounts of material. For example, if a chromatographic separation of a mixture is being performed, this information can be generally derived with two or three experiments.

The invention should find use as an electrospray ion source emitter for all devices which benefit from a controlled gaseous ion stream, such as for ion mobility spectrometry, to generate an aerosol for drug delivery by inhalation, spot preparation for matrix-assisted laser desorption mass spectrometry, crop dusting, paint spraying, ink jet printers and ink jet spotters and surface preparation of thin films of different materials for material science and biological applications. However, the invention is particularly well adapted for use as an electrospray ion source for mass spectrometers.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. An electrospray device, comprising:

a high voltage electrode chamber including;

a flow channel defined by an inner surface of said chamber, said flow channel comprising an inlet for receiving an analyte containing fluid to be ionized and an outlet for transmitting said fluid out from said chamber; and at least one electrode having an exposed surface to said fluid, said electrode removably secured to a spaced apart capping member which together define a flow channel height over said electrode, said electrode electrolytically producing ions from said fluid wherein a length of said flow channel over said electrode is greater than said height.

2. The electrospray device of claim 1, wherein said electrode is remotely located from said outlet of said chamber.

3. The electrospray device of claim 1, wherein said emitter comprises a non-electrically conductive capillary.

4. The electrospray device of claim 1, wherein at least one dimension of said flow channel is modifiable.

5. The electrospray device of claim 4, wherein said fluid height is modifiable.

6. The electrospray device of claim 4, further comprising a feedback and control system and structure for physically modifying at least one dimension of said flow channel based on at least one measurement derived from said fluid transmitted from said chamber.

7. The electrospray device of claim 1, wherein a ratio of said length to said height is at least 10.

8. The electrospray device of claim 1, wherein a ratio of said length to said height is at least 100.

9. The electrospray device of claim 1, wherein said ratio of said length to said height is at least 1000.

10. The electrospray device of claim 1, wherein said capping member is formed from at least one chemically resistant polymer material.

11. The electrospray device of claim 1, further comprising an electrode support, wherein said electrode is disposed in said electrode support.

12. The electrospray device of claim 11, wherein said electrode support includes said electrode and at least one other electrode, said electrodes both in contact with said fluid.

13. The electrospray device of claim 12, wherein said electrodes have different properties, said different properties being at least one selected from the group consisting of different electrochemical potentials, different kinetic properties and different catalytic properties.

14. The electrospray device of claim 12, further comprising structure for application of said different potentials to said at least two electrodes.

15. The electrospray device of claim 1, wherein said capping member comprises at least one capping electrode, wherein said capping electrode is in contact with said fluid.

16. The electrospray device of claim 15, wherein said electrode is formed from a first material and said capping electrode is formed from a second material, said first material and said second material have different properties, said different properties being at least one selected from the group consisting of different electrochemical potentials, different kinetic properties and different catalytic properties.

17. The electrospray device of claim 16, further comprising structure for applying a potential difference between said electrode and said capping electrode.

18. The electrospray device of claim 17, wherein said structure for applying a potential difference includes a voltage divider.

19. The electrospray device of claim 1, wherein said at least one electrode comprises at least two electrodes, further comprising a switching network for switching connection to a high voltage power supply between respective electrodes.

20. The electrospray device of claim 1, wherein said surfaces of said electrode is substantially planar.

21. The electrospray device of claim 8, wherein said electrode support and said capping member are substantially planar.

22. The electrospray device of claim 8, further comprising a flow member disposed between said capping member and said electrode support.

23. The electrospray device of claim 22, wherein said capping member includes at least one electrode.

24. A mass spectrometer, comprising, a high voltage electrode chamber including:

a flow channel defined by an inner surface of said chamber, said flow channel comprising an inlet for receiving an analyte containing fluid to be ionized and an outlet for transmitting said fluid out from said chamber;

at least one electrode having an exposed surface to said fluid, said electrode removably secured to a spaced apart capping member which together define a flow channel height over said electrode, said electrode for electrolytically producing ions from said fluid, wherein a length of said flow channel over said electrode is greater than said height, and an orifice plate remotely located from said chamber for receiving gas phase ions emitted from said outlet under influence of an electrical field between said electrode and said orifice plate.

25. A method of creating charged droplets, comprising the steps of:

providing a high voltage electrode chamber including: a flow channel defined by an inner surface of said chamber, said flow channel comprising an inlet for receiving an analyte containing fluid to be ionized and an outlet for transmitting said fluid out from said chamber, and at least one electrode having an exposed surface to said fluid, said electrode removably secured to a spaced apart capping member which together define a flow channel height over said electrode, said electrode electrolytically producing ions from said fluid, wherein a length of said flow channel over said electrode is greater than said height, disassembling said chamber, changing at least one of said electrode, said capping member, or a structure between said electrode and said capping member, and returning said chamber to service.

26. The method of claim 25, further comprising the step of emitting a plume of gas phase ions from ions generated by said electrode.

27. The method of claim 25, wherein said electrode comprises at least two electrodes, farther comprising the step of dynamically switching an electrical potential between respective ones of said at least two electrodes.

28. The method of claim 25, wherein said electrode comprises at least two electrodes, further comprising the step of applying a potential difference between at least two of said at least two electrodes.

29. The method of claim 25, further comprising the step of dynamically changing at least one dimension of said flow channel.

30. The method of claim 29, wherein said at least one dimension includes said channel height.

31. The method of claim 29, wherein said dynamic changing is responsive to at least one measured parameter relating to said fluid, said measured parameter being derived from said fluid.

32. The method of claim 31, wherein said dynamic changing comprises altering a force applied to said electrode chamber, wherein said height is modified.

33. The method of claim 25, wherein said plume of gas phase ions are used for at least one process selected from the group consisting of ion mobility spectrometry, drug delivery by inhalation, spot preparation for matrix-assisted laser desorption mass spectrometry, crop dusting, paint spraying, ink jet printers, ink jet spotters, surface preparation of thin films and mass spectrometry.

* * * * *